US009874405B2

(12) United States Patent
Duerr et al.

(10) Patent No.: US 9,874,405 B2
(45) Date of Patent: Jan. 23, 2018

(54) HEAT EXCHANGER

(71) Applicant: MAHLE International GmbH, Stuttgart (DE)

(72) Inventors: Gottfried Duerr, Ludwigsburg (DE); Uwe Foerster, Erdmannhausen (DE); Martin Kaspar, Fellbach (DE); Wolfgang Seewald, Tamm (DE); Siegfried Tews, Stuttgart (DE); Christoph Walter, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 135 days.

(21) Appl. No.: 14/830,010

(22) Filed: Aug. 19, 2015

(65) Prior Publication Data

US 2015/0354900 A1 Dec. 10, 2015

Related U.S. Application Data

(63) Continuation of application No. PCT/EP2014/053627, filed on Feb. 25, 2014.

(30) Foreign Application Priority Data

Feb. 27, 2013 (DE) ..... 10 2013 203 222

(51) Int. Cl.
*F28F 9/00* (2006.01)
*F28D 9/00* (2006.01)
(Continued)

(52) U.S. Cl.
CPC ..... *F28D 9/0093* (2013.01); *F28D 1/05391* (2013.01); *F28F 9/0214* (2013.01); *F28F 9/0224* (2013.01)

(58) Field of Classification Search
CPC ... F28D 1/05391; F28F 9/0202; F28F 9/0204; F28F 9/0214; F28F 9/0224
(Continued)

(56) References Cited

U.S. PATENT DOCUMENTS 4,917,180 A 4/1990 Wolf et al.
4,971,145 A 11/1990 Lyon
(Continued)

FOREIGN PATENT DOCUMENTS

CN 1768244 A 5/2006
CN 102207347 A 10/2011
(Continued)

OTHER PUBLICATIONS

Sasaki, JP04187991TRANS (English Translation), Jul. 1992.*
(Continued)

*Primary Examiner* — Justin Jonaitis
*Assistant Examiner* — Eric Ruppert
(74) *Attorney, Agent, or Firm* — Muncy, Geissler, Olds & Lowe, P.C.

(57) ABSTRACT

A heat exchanger with mutually adjacent first flow channels and second flow channels. The first flow channels and the second flow channels are received in a first manifold at a first end region of the flow channel end regions and in a second manifold at a second end region of the flow channel end regions. The first manifold has a first base and the second manifold has a second base, the first base and second base having a plurality of openings in which the end regions of the flow channels are received. The first manifold has a first longitudinal channel and a second longitudinal channel. The second manifold has a second cover which together with the second base of the second manifold forms transverse chan-
(Continued)

nels, and one first flow channel and one second flow channel are fluidically connected to each other via a respective transverse channel.

15 Claims, 6 Drawing Sheets

(51) Int. Cl.
*F28D 1/053* (2006.01)
*F28F 9/02* (2006.01)

(58) Field of Classification Search
USPC ..... 165/176
See application file for complete search history.

(56) References Cited

U.S. PATENT DOCUMENTS

| | | | | |
|---|---|---|---|---|
| 6,263,570 | B1 * | 7/2001 | Cazacu | F28D 1/05383 165/173 |
| 7,481,266 | B2 | 1/2009 | Demuth et al. | |
| 7,578,340 | B2 | 8/2009 | Förster et al. | |
| 8,776,873 | B2 | 7/2014 | Mross et al. | |
| 9,097,469 | B2 | 8/2015 | Foerster et al. | |
| 2005/0217838 | A1 * | 10/2005 | Katoh | F28F 17/005 165/176 |
| 2006/0162917 | A1 | 7/2006 | Park et al. | |
| 2011/0017433 | A1 | 1/2011 | Feberwee et al. | |
| 2011/0284195 | A1 | 11/2011 | Chowdhury et al. | |
| 2012/0138282 | A1 | 6/2012 | Foerster et al. | |
| 2013/0299150 | A1 | 11/2013 | Bellenfant et al. | |
| 2014/0245777 | A1 | 9/2014 | Katoh et al. | |

FOREIGN PATENT DOCUMENTS

| | | | | |
|---|---|---|---|---|
| CN | 102449425 | A | | 5/2012 |
| CN | 202216603 | U | | 5/2012 |
| DE | 103 15 371 | A1 | | 10/2004 |
| DE | 102005041724 | | * | 5/2006 |
| DE | 10 2006 057 585 | A1 | | 6/2007 |
| DE | 10 2007 060 508 | A1 | | 6/2009 |
| DE | 10 2008 061 762 | A1 | | 6/2010 |
| DE | 10 2009 023 954 | A1 | | 12/2010 |
| EP | 1 998 133 | A1 | | 12/2008 |
| EP | 2 372 289 | A2 | | 10/2011 |
| JP | 04187991 | | * | 7/1992 |
| JP | 2007-155268 | A | | 6/2007 |
| JP | 2012-225638 | A | | 11/2012 |
| WO | WO 2012/041441 | A2 | | 4/2012 |

OTHER PUBLICATIONS

Walter, DE102005041724MT (English Translation), May 2006.*
Chinese Office Action for Chinese Application No. 201480010998.1 dated Sep. 1, 2016 with English translation.

* cited by examiner

HEAT EXCHANGER

This nonprovisional application is a continuation of International Application No. PCT/EP2014/053627, which was filed on Feb. 25, 2014, and which claims priority to German Patent Application No. 10 2013 203 222.6, which was filed in Germany on Feb. 27, 2013, and which are both herein incorporated by reference.

BACKGROUND OF THE INVENTION

Field of the Invention

The invention relates to a heat exchanger with mutually adjacent first flow channels and second flow channels, whereby the first flow channels and the second flow channels at a first end region are received in a first header and at a second end region in a second header, whereby the first header has a first base and a first cover and the second header has a second base and a second cover, whereby the first base and the second base have a plurality of openings in which the end regions of the flow channels are received, whereby the first header has a first longitudinal channel and a second longitudinal channel, whereby the first flow channels are in fluid communication with the first longitudinal channel and the second flow channels are in fluid communication with the second longitudinal channel.

Description of the Background Art

Apart from known PTC (positive temperature coefficient) heating elements, heat pumps can also be used for climate control, particularly for the heating, of electric vehicle and hybrid vehicles but also in conventionally powered motor vehicles. To enable the greatest possible range for vehicles, a lowest possible power requirement of the climate control system is preferred.

The use of a heat pump is advantageous in comparison with the use of a PTC heating element, because the power requirement is much lower. The power requirement of a heat pump is approximately half as a great as the power requirement of a PTC heating element.

The heat exchanger, which functions as a condenser in the heat pump mode of a climate control system and is thereby used as a heat source for heating the passenger compartment, is often integrated into the climate control unit itself. The result is that only a small installation space is available for the condenser. This is especially disadvantageous for the temperature distribution within the condenser.

Two-row arrangements of the condenser can be used nevertheless to achieve an advantageous temperature distribution in the condenser, particularly in the condensation of the refrigerant. These are characterized in that two rows of tubes are arranged one behind the other in the air flow direction.

Designs with two headers per row in each case are known in the prior art for the realization of two-row condensers. This results in disadvantages, such as a higher required refrigerant amount, a more laborious soldering of the components, or a tightness of the connections that is difficult to produce.

SUMMARY OF THE INVENTION

It is therefore an object of the present invention provide a heat exchanger that is optimized compared with the prior art. It is an object of the invention further to provide an arrangement of a heat exchanger in a climate control system.

An exemplary embodiment of the invention relates to a heat exchanger with mutually adjacent first flow channels and second flow channels, whereby the first flow channels and the second flow channels at a first end region are received in a first header and at a second end region in a second header, whereby the first header has a first base and a first cover and the second header has a second base and a second cover, whereby the first base and the second base have a plurality of openings in which the end regions of the flow channels are received, whereby the first header has a first longitudinal channel and a second longitudinal channel, whereby the first flow channels are in fluid communication with the first longitudinal channel and the second flow channels are in fluid communication with the second longitudinal channel, whereby the second header has a second cover, which together with the second base of the second header forms cross channels, whereby in each case a first flow channel and a second flow channel are in fluid communication with one another via a cross channel.

The heat exchanger can be designed such that a fluid can flow via a fluid inlet into one of the longitudinal channels, for example, the first longitudinal channel, of the first header and can be distributed there via the flow channels associated with the particular longitudinal channel. The fluid then flows through the particular flow channels, for example, the first flow channels, and is redirected in the second header into the further flow channels, for example, the second flow channels. To this end, the second header forms cross channels, which in each case fluidically connect a first flow channel to a second flow channel. The fluid then flows back into the first header, but here in the further longitudinal channel, for example, the second longitudinal channel. From there, the fluid can flow out of the heat exchanger via a fluid outlet.

The first and second flow channels can each be arranged in rows and mutually adjacent, so that the first flow channels form the first row of the heat exchanger and the second flow channels the second row. The first and second rows are arranged one behind the other in the main flow direction of the fluid, flowing around the flow channels.

The cross channels can be oriented so that in each case flow channels from the first row are connected to the flow channels from the second row. The longitudinal channels, in contrast, are oriented so that they connect a plurality of flow channels of a row with one another. In general, a transverse orientation here stands for an orientation of an element of one row to the respective further row of flow channels. A lengthwise orientation here stands for an orientation of an element along a row of flow channels.

The volume of fluid required overall within the heat exchanger can be reduced by a fluidic connection of in each case a first flow channel with in each case a second flow channel, because the second header has a smaller internal volume overall than a conventional header. This is especially advantageous.

The cross channels in the second header, moreover, represent a tolerance compensation for the flow channels inserted in the bases of the headers and formed by tubes. In addition, they facilitate the fluid transfer from the flow channels into the headers in that they increase the volume of the header at the end region of the flow channels.

The first cover together with the first base can form pockets, which in each case can be arranged in alignment with one of the openings of the first base and/or with the ends of the flow channels.

The pockets in the first longitudinal channel, like the cross channels in the second flow channel, also can serve as tolerance compensation for the tubes inserted in the openings of the first base. In addition, the arrangement of the pockets is advantageous to achieve a better fluid flow from the longitudinal channels into the flow channels or vice versa.

An exemplary embodiment provides that the second cover has a wave-like contour in a longitudinal section, whereby in each case the wave troughs can be in contact with the base of the second header and the wave peaks together with the connecting elements form the second cross channels.

The second cover can be formed from a metal strip, which has a wave-like contour, which has been created, for example, by a forming process. The wave peaks in the fully assembled state are positioned so that they lie opposite to the passages of the second base. The fluid transfer occurs from the particular flow channels into the cross channel formed by the wave peak. The first flow channels are in fluid communication with the second flow channels via the cross channel.

The wave troughs in this case can be in direct contact with the second base and, for example, can be soldered, glued, or welded with it. A fluid-tight separation of the cross channels from one another is achieved in this way.

The wave troughs and the wave peaks in each case can lie in a mutual plane, whereby the wave-like contour can be made as a rounded wave profile or as a rectangular profile or as a trapezoidal profile.

This is especially advantageous, because due to the arrangement of the wave troughs and wave peaks in each case in one plane, it is especially simple to connect the cover to the base by a material bonding method, because large areas of the cover are in extensive contact with areas of the base.

The openings in the bases can have passages, whereby the passages can be directed away from the interior of the headers toward the flow channels.

In order to keep the internal volume of the header as small as possible, it is especially advantageous if the passages are oriented away from the interior of the headers. An increase in the stability of the heat exchanger can thus be achieved by the passages, because the tubes of the flow channels are run in the passages; at the same time, the headers can be dimensioned in such a way that a lowest possible internal volume is required, which leads to a reduction in the required amount of fluid.

In an embodiment of the invention, it is provided in addition that the bases on the longitudinal sides can have at least partially upstanding edge regions, which laterally close the longitudinal channels and/or the cross channels and/or the pockets.

The upstanding edge regions can have a bottom edge region, which is formed by a continuous metal strip, whereby a plurality of crenellated sealing elements upwardly join to the bottom edge region.

The at least partially upstanding edge regions of the bases facilitate the positioning of the cover in the assembly process. At the same time, a lateral sealing of the longitudinal and/or cross channels and/or pockets can be achieved via the edge regions. The covers can be dimensioned so that in the fully assembled state they abut against the upstanding edge regions and particularly against the crenellated sealing elements, which join to the bottom edge region. The fluid-tight connection between the covers and the upstanding edge region can then be created by methods such as, for example, soldering, gluing, or welding.

It can be provided in an embodiment of the invention that the at least partially upstanding edge regions can have fixing elements via which the covers can be fixed to the bases.

The covers can be fixed in the bases at the edge regions via the fixing elements until a permanent fluid-tight connected is created. This can be achieved, for example, via lugs which upon insertion of the covers come into contact with them and fix the covers.

It can be provided according to an embodiment of the invention that the pockets in the first cover can be formed by indentations, which are introduced into an edge running laterally parallel to the first longitudinal channel and to the second longitudinal channel and in each case merge into the first longitudinal channel or the second longitudinal channel.

In order to utilize the installation space as optimally as possible, it can be provided that the passages or the tubes of the flow channels can extend over the entire width of the longitudinal channel. Because for the purpose of attachment to the base the cover usually has an edge that lies flat against it, it can be advantageous to provide the edge with indentations in the areas lying opposite to the passages. It can be prevented with the indentations that the passages are covered by the edge of the cover and thus the area by means of which a fluid transfer between the header and the flow channels can occur is reduced.

By means of the above-described design of the edges, the header can be made narrower than in an embodiment without indentations in the edges and thereby nonetheless have the same fluid transfer area as a wider header.

Moreover, the cross channels and/or pockets and/or passages can have a variable cross section.

The cross channels and/or pockets and/or passages can have a variable cross section. Designs with favorable flows can be realized in this way. The design of the passage or cross channel can occur, for example, such that flow out of the flow channel is promoted, for instance, in that the passage widens trumpet-like in the fluid flow direction. In addition to a widening or a narrowing, it can also be provided, for example, that the contours of the cross channels or passages are rounded off to prevent the fluid flow from backing up in the area of sharp edges or corners or being negatively affected in some other way.

An exemplary embodiment provides that the first longitudinal channel and/or the second longitudinal channel have one or more partition walls that divide the particular longitudinal channel into a number of sections.

The throughflow sequence of the heat exchanger can be influenced by the arrangement of one or more partition walls in one or more longitudinal channels. This is especially advantageous, if the aim is to achieve that the fluid in the interior of the heat exchanger is to flow back and forth repeatedly between the first and second headers. The partition walls can divide the longitudinal channel into a number of sections which are flown through one after another. The fluid inlet and the fluid outlet are to be adapted accordingly.

An exemplary embodiment also relates to the arrangement of a heat exchanger in a climate control system, whereby the heat exchanger is a two-row condenser and is arranged within a climate control unit of a climate control system, whereby the first flow channels form the first row and the second flow channels form the second row, whereby a first fluid can flow through the first flow channels and the second flow channels and a second fluid can flow around them.

An arrangement of a heat exchanger as described above in a climate control system is especially advantageous, because it is characterized in particular by a compact construction and therefore can be easily integrated into the small available space in a climate control unit of a climate control system. The two-row construction of the heat exchanger simultaneously assures a high heat exchanger efficiency.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
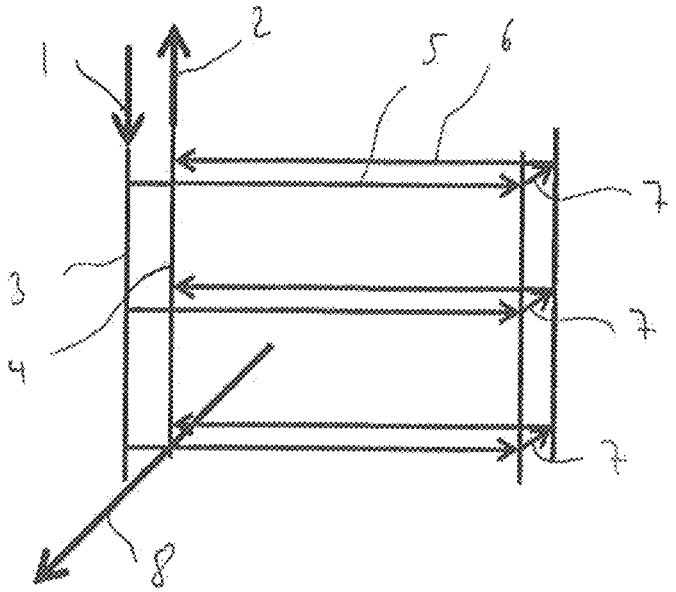
FIG. 1 shows a flow-through principle of a heat exchanger of the invention.

FIG. 1 shows an illustration of a flow-through principle of a heat exchanger. The heat exchanger in this case includes two rows of flow channels 5, 6, arranged one behind the other. A fluid can flow via a fluid inlet 1 into a first longitudinal channel 3, formed by a side header. The fluid within longitudinal channel 3 is distributed to flow channels 5 leading to the second header. The fluid flows through flow channels 5 and is redirected in the second header, forming cross channels 7, to the further flow channels 6, which lead back from the second header to the first header. The fluid flows out of flow channels 6 into second longitudinal channel 4, formed by the first header, and through fluid outlet 2 out of the heat exchanger.

A second fluid, for example, air, flows around the rows of flow channels 5, 6 along flow direction 8, said rows being arranged behind one another.

The flow-through principle shown in FIG. 1 represents a possible form for the flow through a two-row heat exchanger. The introduction of partition walls within longitudinal channels 3, 4 can also realize a flow different from the principle shown in FIG. 1. FIG. 1 is used for the easy understandability of the structure of the heat exchanger following in FIGS. 2 to 10.

Figure 2:
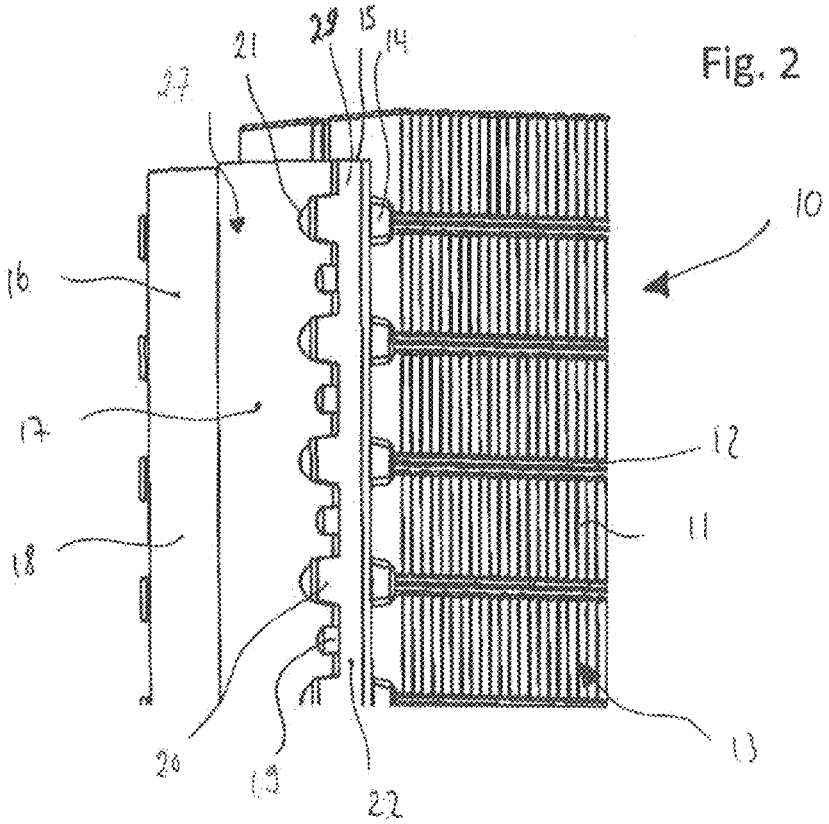
FIG. 2 shows a view of the first header on a heat exchanger block, whereby the header is formed by two longitudinal channel and a plurality of pockets and the heat exchanger block is formed by a plurality of flow channels between which heat transfer elements are arranged.

FIG. 2 shows a heat exchanger 10, formed substantially by a plurality of tubes 12, between which a plurality of heat transfer elements 11 are arranged. Heat transfer elements 11 can be made, for example, with a corrugated fin design.

Tubes 12 with heat transfer elements 11 together form heat exchanger block 13 of heat exchanger 10.

The individual tubes 12 each have two end regions. A first end region opens into header 27 arranged on the left in FIG. 2. The second end region of tubes 12 opens into header 33 arranged on the right. Right header 33 will be described in greater detail in FIGS. 8 to 11.

First header 27 is formed substantially of a base 15 and a cover 16. Base 15 has a plurality of passages 14, which receive the specific end regions of tubes 12. Passages 14 run around openings in base 15, said openings not being shown in FIG. 1.

The formation of passages 14 serves in particular to increase the stability of the connection between tubes 12 and header 27. Passages 14 in this case are arranged on a region of base 15, said region facing away from the interior of header 27, and point towards heat transfer block 13.

Base 15 of header 27 has laterally upstanding edge regions 22. Upstanding edge regions 22 close first header 27 toward the side. The more specific structure of base 15 will be discussed in the following figures.

A cover 16 is inserted in base 15. Cover 16 due to its shape forms a first longitudinal channel 17 and a second longitudinal channel 18. Furthermore, cover 16 has a plurality of pockets 21. Said pockets are positioned in cover 16 such that in the fully assembled state pockets 21 are opposite to passages 14 and thereby to tubes 12. The more precise structure of cover 16 will also be discussed in the following figures.

Upstanding edge region 22 of base 15 furthermore has sealing elements 20 and fixing elements 19. Said fixing elements 19 serve to attach cover 16 to base 15 until a final connection is made between base 15 and cover 16 via a material bonding method, such as, for instance, soldering, gluing, or welding. Sealing elements 20 close pockets 21 and/or longitudinal channels 17, 18 on the side in the region that is not covered by bottom edge region 29, formed by a continuous material strip.

Designs conventional in the art can be used for the embodiment of fixing elements 19. Here, for example, catches can be bent on cover 16, so that they are fixed to base 15. Projections, which protrude over edge region 22 in the region of cover 16 and prevent a slipping out of cover 16, can be provided inter alia.

Figure 3:
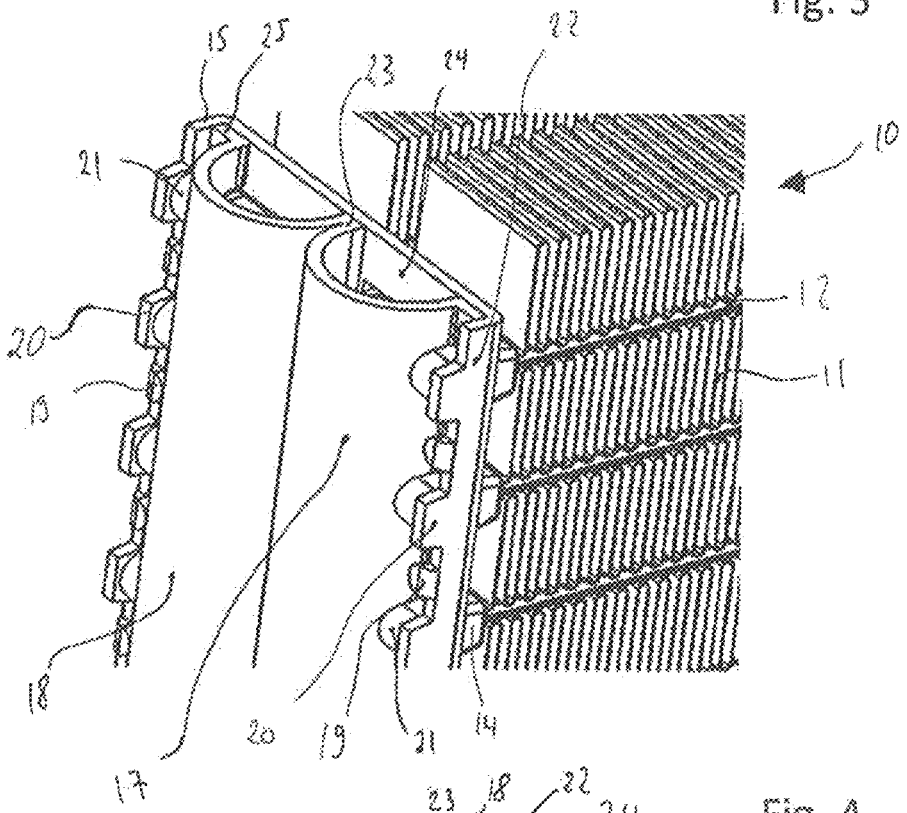
FIG. 3 shows a further view of the first header of FIG. 2.

FIG. 3 shows a further perspective view of the arrangement of heat exchanger 10 from FIG. 2.

It can be seen in FIG. 3 that pockets 21, which project laterally over longitudinal channel 17 or 18, are closed on the sides by sealing elements 22. Pockets 21 are made aligned with passages 14 and tubes 12 inserted in passages 14. Pockets 21 are used substantially to facilitate the flowing in or out of the fluid in tubes 12. Pockets 21 in this case merge into longitudinal channel 17 or 18. A fluid can flow back and forth unimpeded between longitudinal channels 17 or 18 and the respective pockets 21.

Furthermore, a tolerance compensation of tubes 12 is possible by means of pockets 21. The shaping of pockets 21 increases the internal volume within first header 27 via tubes 12.

Sealing elements 20 are made as a crenellated enlargement of bottom edge region 29 of upstanding edge region 22. Base 15 can be made advantageously from a single metal blank by stamping methods and forming methods. This makes the production of base 15 simple and cost-effective.

Furthermore, partition wall 23 which is formed by cover 16 can be seen in FIG. 3. It can be seen in a cross section of first header 27 that first header 27 has a B-shaped contour. In this regard, the back of the B is formed by the planar region 24 of base 15 and the two arches of the B by the physical form of cover 16.

Cover 16 in each case has an edge 25 on the left and right next to longitudinal channels 17, 18. This edge is used substantially as a contact surface of cover 16 with base 15, so that a material connection can be made later between the two elements.

Pockets 21 are introduced as indentations in said edge 25. This is especially advantageous, because header 27 must have a smaller width overall in order to be able to receive tubes 12 and to be able to supply these with a fluid over the entire opening area of tubes 12. If no indentations are provided in edges 25, part of cover 16 would cover the openings of tubes 12 or passages 14 and thus reduce the effectively usable through-flow area of the tubes. This would have a disadvantageous effect on the efficiency of heat exchanger 10.

A most compact possible configuration with the maximum possible performance is advantageous in particular with respect to the preferred field of application of such a heat exchanger 10 within a climate control system.

Cover 16 can also be produced by simple shaping methods from a single blank. Overall, header 27 can thus be produced in a simple manner and particularly cost-effectively.

Figure 4:
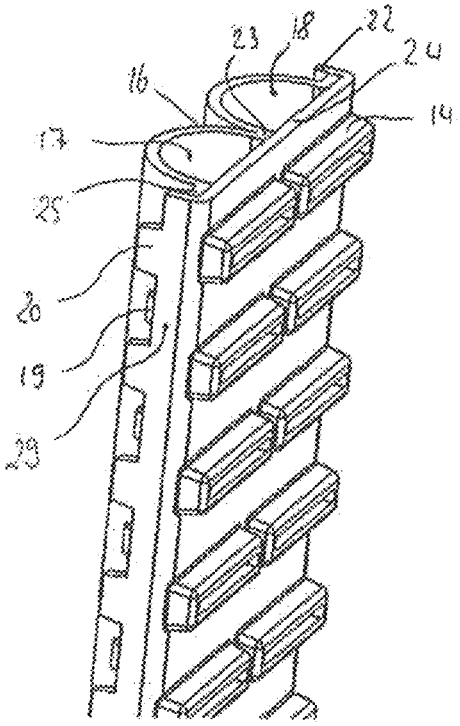
FIG. 4 shows a further view of the first header looking toward the passages facing away from the interior of the header, but without the attached heat exchanger block.

FIG. 4 shows a further perspective view of first header 27. The rest of the heat exchanger or heat exchanger block 13 is not shown in FIG. 4. It can be seen on the bottom side of planar region 24 of base 15 how a plurality of passages 14 are arranged substantially in two rows next to one another. The left half of passages 14 is thereby associated with the first row of tubes 12, and the right half of passages 14 is associated with the second row of tubes 12. Partition wall 23 of cover 16 is situated in the middle between passages 14. Thus, a partitioning of the internal volume of header 27 in longitudinal channels 17, 18 is achieved. Each passage 14 in each case is in fluid communication with only one of longitudinal channels 17, 18.

In alternative embodiments, it can also be provided that the passages do not project outwardly out of the header, but project inwardly into this header.

Figure 5:
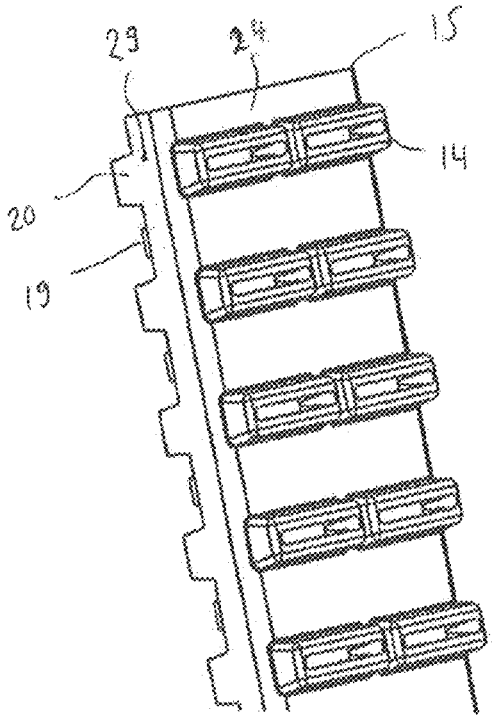
FIG. 5 shows a further view of the first header according to FIG. 4 looking toward the header side facing the heat exchanger block.

FIG. 5 shows a perspective view of base 15, as it was already shown in the preceding figures. Apart from passages 14, the planar region 24 of base 15 in particular and the upstanding edge region 22 can be seen with bottom edge region 29, fixing elements 19, and crenellated sealing elements 20, which upwardly, away from planar region 24, join to bottom edge region 29.

In alternative embodiments, instead of the crenellated design of sealing elements 20, it can also be provided to make bottom edge region 29 higher. This would require a greater amount of material, however, and thus increase the material costs of base 15 overall.

Figure 6:
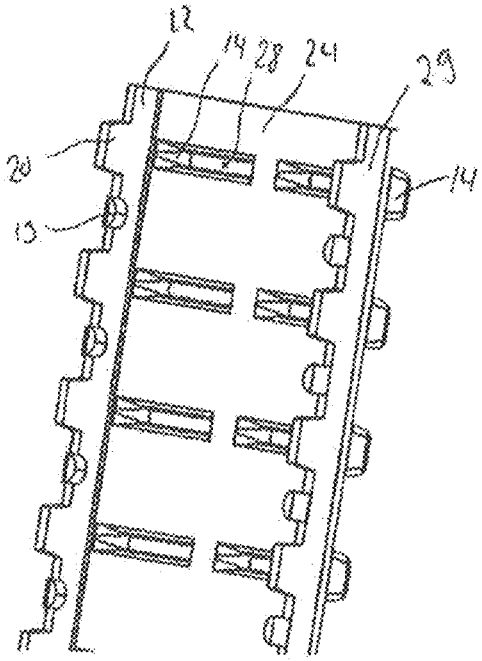
FIG. 6 shows a view of a base of the first or second header, looking toward the base side facing away from the heat exchanger block.

FIG. 6 shows a further view of base 15, as it was already shown in FIG. 5. In FIG. 6, the view is directed toward the inner side of base 15 and particularly planar region 24 of base 15. The design of fixing elements 19 in particular, which are formed as lugs and project over upstanding edge region 22 to the middle of base 15, can be seen in FIG. 6.

A cover 16 must be pressed into base 15 past lugs 19 with a certain application of force. Lugs 19 then prevent an unintended falling of cover 16 out of base 15 until a final material connection is created.

It can be seen further in FIG. 6 that passages 14 or openings 28 in base 15 to passages 14 run over the entire width of base 15 or planar region 24 of base 15. The space between the particular passages 14 is provided as a connecting area for partition wall 23 with planar region 24. The design of pockets 21 shown in the preceding figures assures that a fluid communication between the particular longitudinal channels 17, 18 and tubes 12 can occur over the full width of passages 14.

Figure 7:
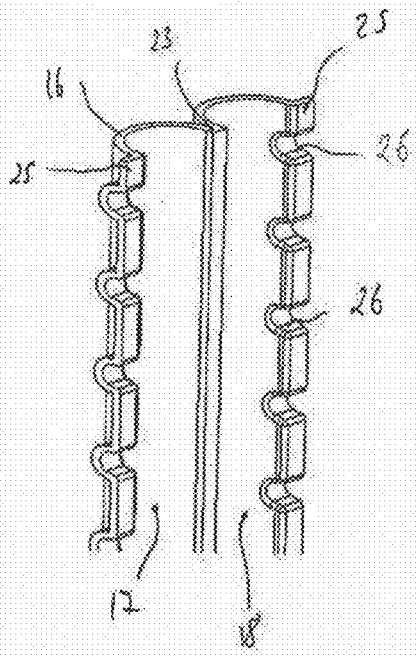
FIG. 7 shows a view of the cover of the first header, looking toward the inner side of the cover, which forms two longitudinal channels and a plurality of pockets with the associated base.

FIG. 7 shows a perspective view of cover 16. In FIG. 7 the view is directed toward the inner side of cover 16. Apart from the two longitudinal channels 17, 18 between which partition wall 23 is disposed, the structure of edge 25 with the plurality of indentations 26 can be seen. Indentations 26 form pockets 21, which enable an inward flow of the fluid over the entire width of the opening of tubes 12 or passages 14. As can be seen in FIG. 7, pockets 21 formed by indentations 26 merge into the associated longitudinal channel 17 or 18.

Indentations 26 are made c-shaped, whereby the open side of the c-shaped arch is oriented in the direction of planar region 24 of base 15. Different designs of the indentations can also be provided in alternative embodiments. For instance, rectangular or tapering trapezoidal indentations can be provided. The design of the sealing elements, which are connected to the bottom edge region of the upstanding edge regions, is to adapted if necessary to a different design of the sealing elements.

A different design of the cover can also be provided in alternative embodiments. Any design that provides for longitudinal channels separated from one another and that allows that in each case a first row of the flow channels is in fluid communication with a first longitudinal channel and in each case a second row of the flow channels is in fluid communication with a second longitudinal channel can be used for an implementation according to the invention. The configuration of cover 16 as shown in FIG. 7 is especially simple and cost-effective to produce.

It can be seen, furthermore, in FIG. 7 that in particular edges 25 and the foot region of partition wall 23 act as contact areas between cover 16 and base 15. The arranging of edges 25 to the side of longitudinal channels 17 or 18 is especially important, to be able to produce a sufficient tightness of header 27. The contact area between cover 16 and base 15, which can be used for connecting the two elements, can be increased by edges 25. This is especially important particularly during use as a condenser in a climate control system, because partially high pressures can occur here and a permanent tightness of the heat exchanger must be assured.

Figure 8:
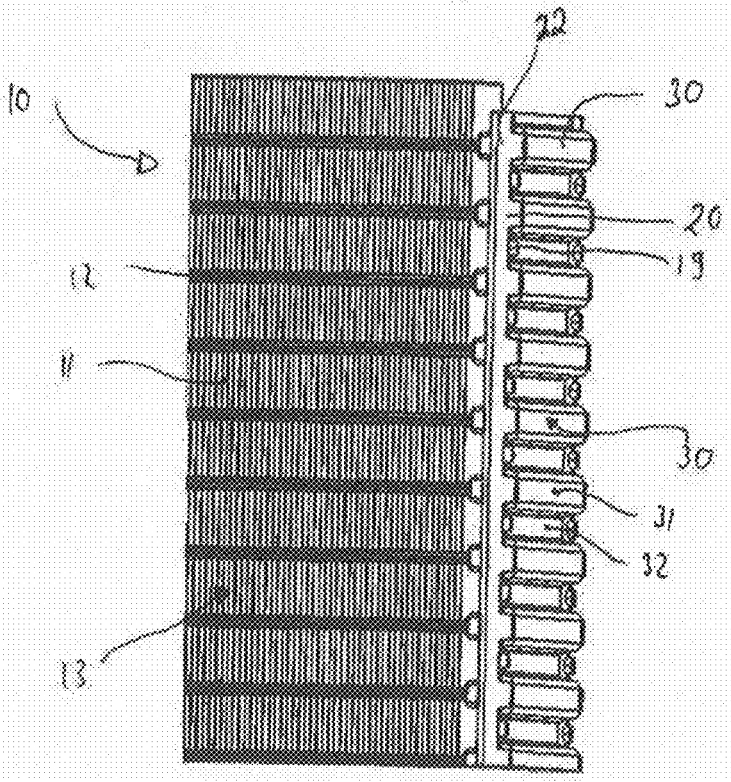
FIG. 8 shows a view of the second header on the heat exchanger block, whereby the second header forms a plurality of cross channels, via which the first and second flow channels are in fluid communication with one another.

FIG. 8 shows a further perspective view of heat exchanger 10 with heat exchanger block 13. The view in FIG. 8 is directed toward right header 33. In comparison with left header 27, right header 33 has a plurality of cross channels 34. The base of header 33 is identical to base 15 of header 27, which was already described in the preceding figures. Only cover 30 of header 33 deviates from the configuration of header 27. The precise structure of cover 30 is explained in the following figures.

In alternative embodiments, a different design of the base can also be provided for the second header. Any header that permits division of the internal volume into a plurality of cross channels, so that at least one flow channel of the first row can be brought into fluid communication with at least one flow channel of the second row via one of the cross channels, can be used for a design according to the invention.

The fluid, which flows through tubes 12 of one row into header 33, is redirected by a plurality of cross channels 34 into the tube of the second row, said tube being located at the same height. Each cross channel 34 is in fluid communication with a tube of the front row and with a tube of the back row.

The required internal volume within header 33 is minimal due to this construction of header 33. Each tube 12 is in fluid communication via only one cross channel 34 with its corresponding tube in the second row. In this way, disadvantageous backups of the fluid within header 33 can also not occur.

It can also be provided, moreover, in alternative embodiments to connect a plurality of tubes in the first row to a plurality of tubes in the second row via individual cross channels. This increases the required internal volume within header 33, however, as a result of which the fluid requirement for operating heat exchanger 10 also increases.

Figure 9:
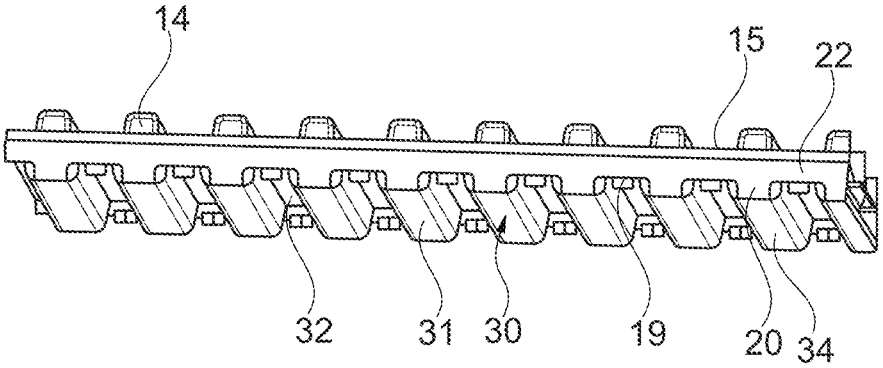
FIG. 9 shows a perspective side view of the second header without the heat exchanger block.

FIG. 9 shows a perspective view of header 33 without the rest of heat exchanger block 13. Header 33 is formed substantially of a base 15, which likewise has a plurality of passages 14 and laterally upstanding edge regions 22, and a cover 30, which has a wave-like contour in the longitudinal section. Sealing elements 20 in each case close cross channels 34 toward the side. Each cross channel 34 is positioned so that it is aligned with two passages 14 of the base. The individual cross channels 34 are separated fluid-tight from one another by connecting sites between cover 30 and base 15. As was also the case for first header 27, cover 30 is fixed via fixing elements 19 within base 15, until a material connection has been made between the two elements.

Figure 10:
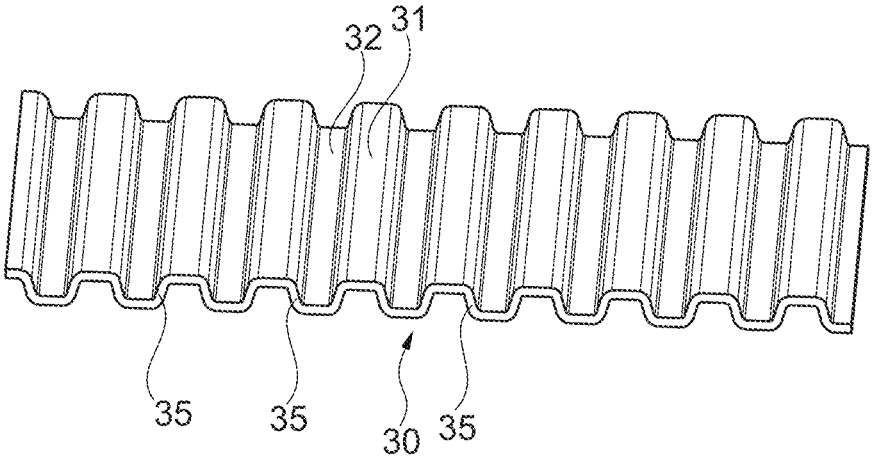
FIG. 10 shows a perspective view of the second cover of the second header, whereby the cover has a wave-like contour.
Figure 11:
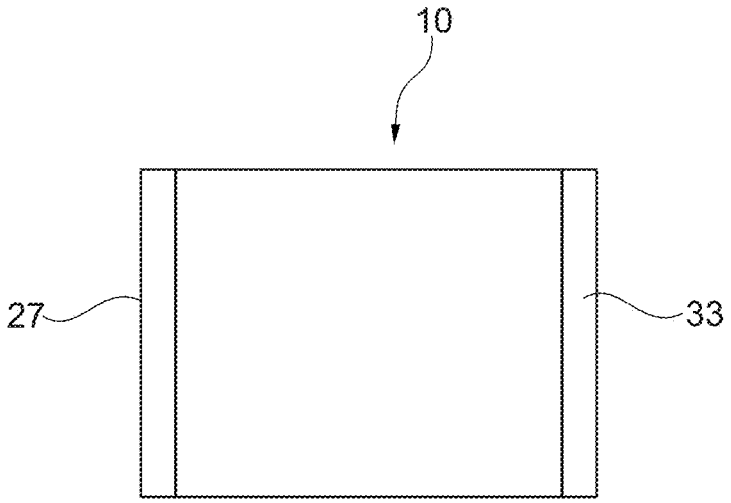
FIG. 11 shows a front view of the heat exchanger with the left and right header.

FIG. 10 shows cover 30 of header 33. As already described in FIG. 9, cover 30 has a wave-like contour in the longitudinal section. Wave troughs 32 and wave peaks 31 in each case lie together in a plane. As a result, cover 30 can be connected especially easily to planar region 24 of base 15.

Cover 30 in the exemplary embodiment shown in FIG. 10 has a wave-like contour, whereby the waves are formed by a trapezoidal section. Connecting elements 35 of cover 30, said elements connecting wave troughs 32 with wave peaks 31, are each oriented such that cross channel 34 narrows from wave trough 32 to wave peak 31. Two connecting elements 35 delimiting a cross channel 34 are inclined toward one another.

In alternative embodiments, wave profiles can also be provided, which are formed by rectangular sections in which the connecting elements are arranged at right angles to the particular wave trough or wave peak. In a further alternative, a wave contour following a sinusoidal course can also be provided.

Wave troughs 32 in this case form the contact sites between cover 30 and base 15, by means of which the material connection occurs. Cross channels 34 are formed by connecting elements 35, which connect wave troughs 32 with wave peaks 31 and wave peaks 31 themselves. The fluid communication between the tubes in the first row and the second row is assured by these cross channels.

Cover 30 can be produced by a shaping process from a blank. The production of cover 30 is therefore especially simple and cost-effective. Furthermore, a dimensioning of cover 30 on a heat exchanger with a greater or smaller number of tubes is possible in a simple way.

The shown embodiment and the described alternatives do not limit the possible embodiments. Any design of the cover that allows formation of a plurality of cross channels for connecting the flow channels of the first row to the flow channels in the second row can be provided.

Moreover, the embodiments of the rest of the figures are not limiting in nature.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

mutually adjacent first flow channels;

second flow channels;

a first header having a first base and a first cover;

a second header having a second base and a second cover;

wherein the first flow channels and the second flow channels, at a first end region, are received in the first header and at a second end region, are received in the second header, wherein the first base and the second base have a plurality of openings in which the first and second end regions of the first and second flow channels are received, wherein the first cover has a first longitudinal channel, a second longitudinal channel and pockets that extend from one side surface of each of the first longitudinal channel and the second longitudinal channel, the pockets forming space-apart side channels that each extend in an axial direction that is perpendicular to an axial direction of each of the first longitudinal channel and the second longitudinal channel, wherein the first flow channels are in fluid communication with the first longitudinal channel and the second flow channels are in fluid communication with the second longitudinal channel, wherein the second cover of the second header, together with the second base of the second header, forms cross channels, wherein the first flow channels and the second flow channels are each in fluid communication with one another via the cross channels, wherein the first base and the second base, on the longitudinal sides, have at least partially upstanding edge regions, which laterally close the first and second longitudinal channels, the cross channels and the pockets, and wherein the upstanding edge regions have a bottom edge region, which is formed by at least one continuous material strip, and wherein a plurality of crenellated sealing elements upwardly extend from the bottom edge region.

2. The heat exchanger according to claim 1, wherein the pockets are each arranged in alignment with one of the openings of the first base and with the first end regions of the first and second flow channels.

3. The heat exchanger according to claim 1, wherein the second cover has a wave-like contour in a longitudinal section with wave troughs and wave peaks, wherein the wave troughs are in contact with the base of the second header, and wherein the wave peaks together with connecting elements, that connect the wave peaks to the wave troughs, form the cross channels.

4. The heat exchanger according to claim 3, wherein the wave-like contour is made as a rounded wave profile or as a rectangular profile or as a trapezoidal profile.

5. The heat exchanger according to claim 1, wherein the openings in the first base and the second base have passages, and wherein the passages are directed away from the interior of the first header and the second header, respectively, toward the first and second flow channels.

6. A heat exchanger comprising:

mutually adjacent first flow channels;

second flow channels;

a first header having a first base and a first cover;

a second header having a second base and a second cover;

wherein the first flow channels and the second flow channels, at a first end region, are received in the first header and at a second end region, are received in the second header, wherein the first base and the second base have a plurality of openings in which the first and second end regions of the first and second flow channels are received, wherein the first cover has a first longitudinal channel, a second longitudinal channel and pockets that extend from one side surface of each of the first longitudinal channel and the second longitudinal channel, the pockets forming space-apart side channels that each extend in an axial direction that is perpendicular to an axial direction of each of the first longitudinal channel and the second longitudinal channel, wherein the first flow channels are in fluid communication with the first longitudinal channel and the second flow channels are in fluid communication with the second longitudinal channel, wherein the second cover of the second header, together with the second base of the second header, forms cross channels, wherein the first flow channels and the second flow channels are each in fluid communication with one another via the cross channels wherein the first base and the second base, on the longitudinal sides, have at least partially upstanding edge regions, which laterally close the first and second longitudinal channels, the cross channels and the pockets, and wherein the upstanding edge regions have fixing elements via which the first cover and the second cover are fixable to the first base and the second base, respectively.

7. The heat exchanger according to claim 2, wherein the pockets in the first cover are formed by indentations, which are introduced in an edge running laterally parallel to the first longitudinal channel and to the second longitudinal channel and merge into the first longitudinal channel or the second longitudinal channel.

8. The heat exchanger according to claim 2, wherein the cross channels and pockets have a variable cross section.

9. The heat exchanger according to claim 1, wherein at least one of the first longitudinal channel or the second longitudinal channel have one or more partition walls that divide the at least one of the first longitudinal channel or the second longitudinal channel into a number of sections.

10. An arrangement of a heat exchanger according to claim 1 in a climate control system, wherein the heat exchanger is a two-row condenser and is arranged within a climate control unit of a climate control system, wherein the first flow channels form a first row and the second flow channels form a second row, and wherein a first fluid flows through the first flow channels and the second flow channels and a second fluid flows around the first flow channels and the second flow channels.

11. The heat exchanger according to claim 5, wherein the passages surround each of the openings in the first base and the second base such that each opening is surrounded by a respective passage, and wherein each passage protrudes from an exterior surface of one of the first base or the second base.

12. The heat exchanger according to claim 5, wherein the passages are spaced apart from one another.

13. The heat exchanger according to claim 1, wherein a total number of pockets is equal to a combined total number of the first flow channels and the second flow channels.

14. The heat exchanger according to claim 1, wherein the sealing elements are aligned with the pockets, such that each respective sealing element laterally closes a respective one of the pockets.

15. The heat exchanger according to claim 6, wherein the upstanding edge regions have a bottom edge region, which is formed by at least one continuous material strip, and wherein a plurality of crenellated sealing elements upwardly extend from the bottom edge region and wherein the fixing elements and the sealing elements alternate in position along the upstanding edge region.

* * * * *